US010131411B1

(12) United States Patent
Bean et al.

(10) Patent No.: US 10,131,411 B1
(45) Date of Patent: Nov. 20, 2018

(54) ARM RESCUE DEVICE

(71) Applicants: Melinda Bean, Smyma, GA (US); Eric Christophersen, Smyma, GA (US)

(72) Inventors: Melinda Bean, Smyma, GA (US); Eric Christophersen, Smyma, GA (US)

( * ) Notice: Subject to any disclaimer, the term of this patent is extended or adjusted under 35 U.S.C. 154(b) by 0 days.

(21) Appl. No.: 15/732,659

(22) Filed: Dec. 11, 2017

(51) Int. Cl.
*B63C 9/00* (2006.01)

(52) U.S. Cl.
CPC ..... *B63C 9/00* (2013.01)

(58) Field of Classification Search
CPC ..... B63C 9/00
USPC ..... 16/406, 426, 422
See application file for complete search history.

(56) References Cited

U.S. PATENT DOCUMENTS 5,234,144 A * 8/1993 Iler ..... B63C 9/20 220/375
7,918,701 B2 * 4/2011 Spinoza ..... B63C 9/155 441/108
2002/0042234 A1 * 4/2002 Wallasch ..... A62B 1/00 441/80
2005/0120519 A1 * 6/2005 Tarpinian ..... A45C 13/26 16/422
2005/0217017 A1 * 10/2005 Moser ..... A47K 3/003 4/577.1
2012/0094561 A1 * 4/2012 Raven ..... B63C 9/08 441/80
2012/0222269 A1 * 9/2012 Anderson ..... B60N 3/026 16/422

* cited by examiner

*Primary Examiner* — Stephen P Avila

(57) ABSTRACT

An arm rescue device with a long rigid grab handle, a short rigid grab handle, a first and second attachment strap designed to be attached to the forearm of a person. The long grab handle terminates at both ends in a downward disposed extension post which each terminate in an attachment plate. The short grab handle is attached in a perpendicular orientation to the long grab handle. The first and second attachment straps each include a double layer allowing each attachment plate to reside between the double layers causing the attachment plates to be fixed to the attachment straps. A preferred embodiment includes the grab handles having resilient rubber-like coverings that provide a more secure grip for a rescuer when in the process rescuing a person wearing the arm rescue device.

3 Claims, 7 Drawing Sheets

ARM RESCUE DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of water rescue devices and more specifically to an arm rescue device.

People in boating, canoeing, kayaking or rafting activities risk the possibility of being accidentally displaced from their water born device and landing in the water. In some cases, a poor swimmer, or even a relatively good swimmer, in a water rapids condition, may need rescuing.

Generally, the rescuer will try to grab the displaced person's arm or hand to then pull them up into a boat or onto land. At least one person has designed a device to help facilitate the rescue of an individual using a strap attached to the arm of the person being rescued. U.S. Pat. No. 7,918,701 by Mark Spinoza shows a rescue device that includes arm sleeves that also include buoyancy rings. The sleeves shown in FIG. 3 show a strap attached to the end of each arm sleeve for rescue purposes.

However, there is a deficiency in the prior technology in that a rescuer may have success by grabbing a handle that extends parallel to the rescuers forearm, or the rescuer may have better success by grabbing a handle that is perpendicular to the rescuers arm. Therefore, it would be ideal to have an arm rescue device that includes both a parallel and a perpendicular rescue handle.

BRIEF SUMMARY OF THE INVENTION

The primary object of the invention is an arm rescue device that can be worn by a person while boating or kayaking or rafting that allows a rescuer to more easily grab the arm or hand of a person that has accidentally fallen into the water.

Another object of the invention is an arm rescue device that allows a rescuer to grab the person wearing the device either by a handle that runs parallel to the wearer's forearm, or by a second handle that is situated near the wearer's hand and is perpendicular to the wearer's arm.

Another object of the invention is an arm rescue device that includes attachment straps that are quickly adjustable to the diameter of the wearer's arm.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an arm rescue device comprising: a long rigid grab handle, a short rigid grab handle, a first attachment strap, a second attachment strap, said long rigid grab handle terminating at the distal end in a downward disposed extension post terminating in a rigid attachment plate, said long rigid grab handle terminating at the proximal end in a downward disposed extension post terminating in a rigid attachment plate and said short rigid grab handle which is perpendicular to said long rigid grab handle, and said first and second attachment straps each including a double layer allowing said rigid attachment plate to reside between the said double layers causing said attachment plates to be fixed to said attachment straps.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
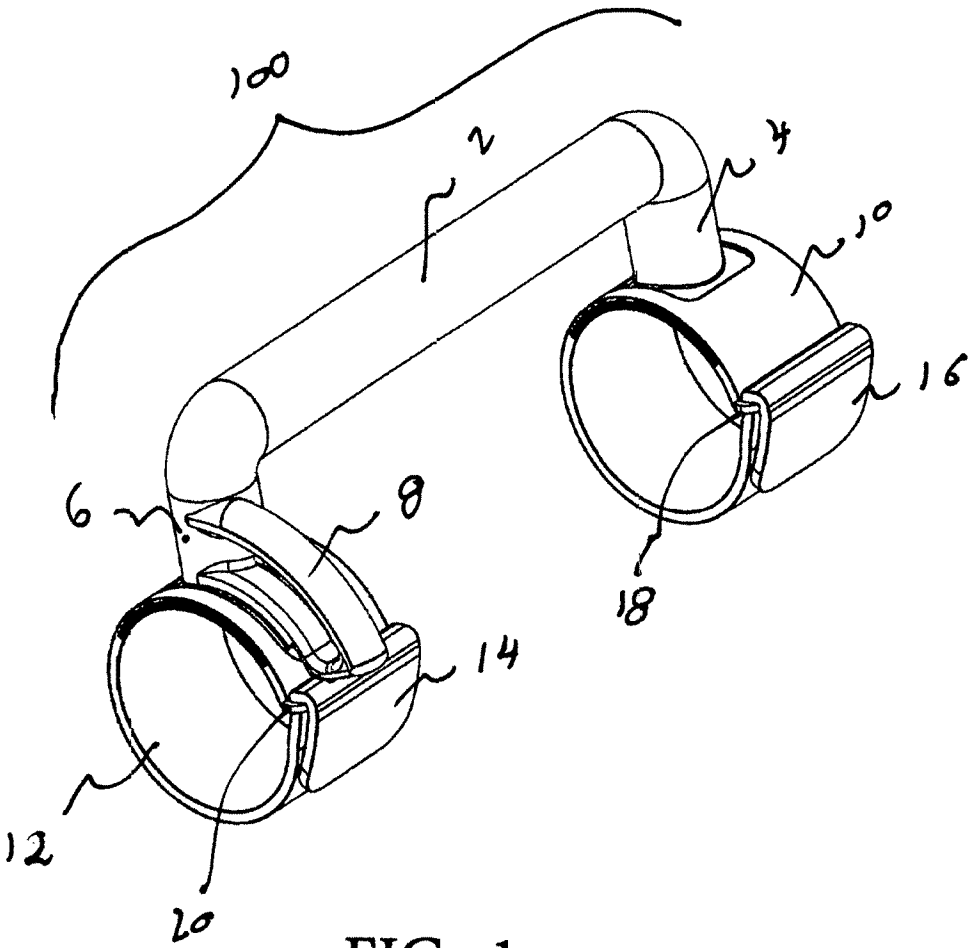
FIG. 1 is a perspective view of the invention.

Referring now to FIG. 1 we see a perspective view of the invention 100. A long rigid handle 2 terminates at each end in downwardly disposed posts 4, 6. The posts 4, 6 each terminate in curved attachment plates 24, 30 which can be more easily seen in the exploded view shown in FIG. 7. The proximal, or forward-most downwardly disposed post 6 includes a short rigid handle 8. The short handle 8 is positioned perpendicularly to long handle 2. Attachment straps 10, 12 allow the user to attach the device 100 to his or her arm by inserting the ends 14, 16 of the straps 12. 10 and folding them over rectangular metal retainers 18. 20 so that the hook portion 26 at the end of the strap as shown in FIG. 4 can engage the loop portion 28 located on the main body of the strap thereby fastening the entire assembly 100 to the wearer's arm.

Figure 2:
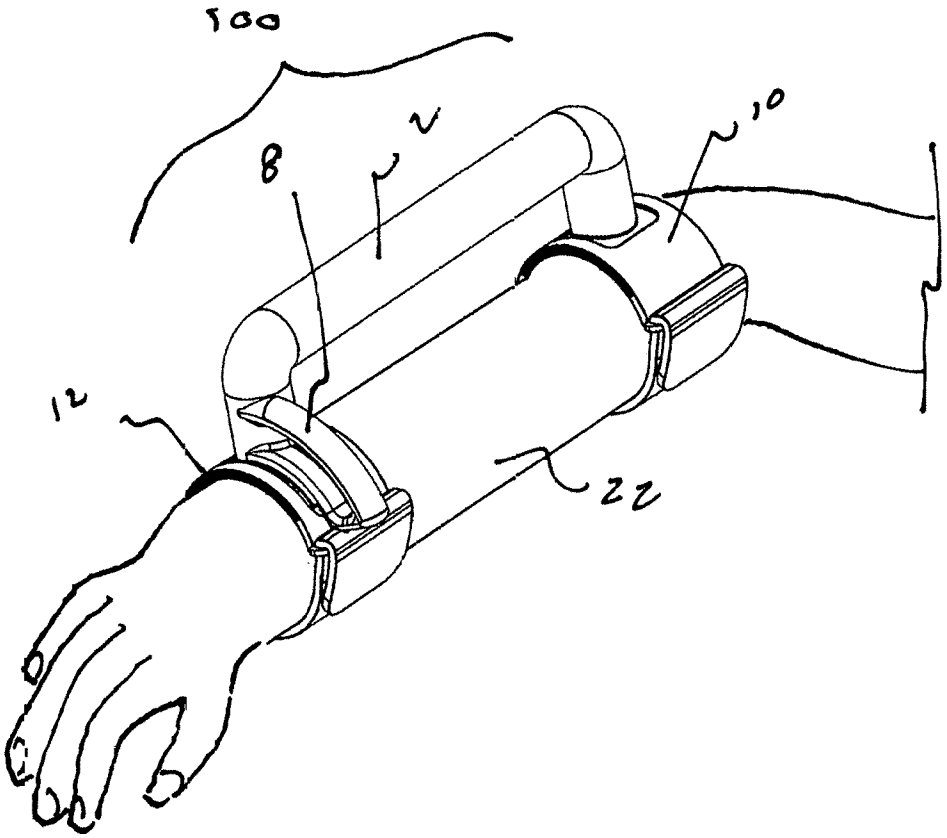
FIG. 2 is a perspective view of a person wearing the invention.
Figure 3:
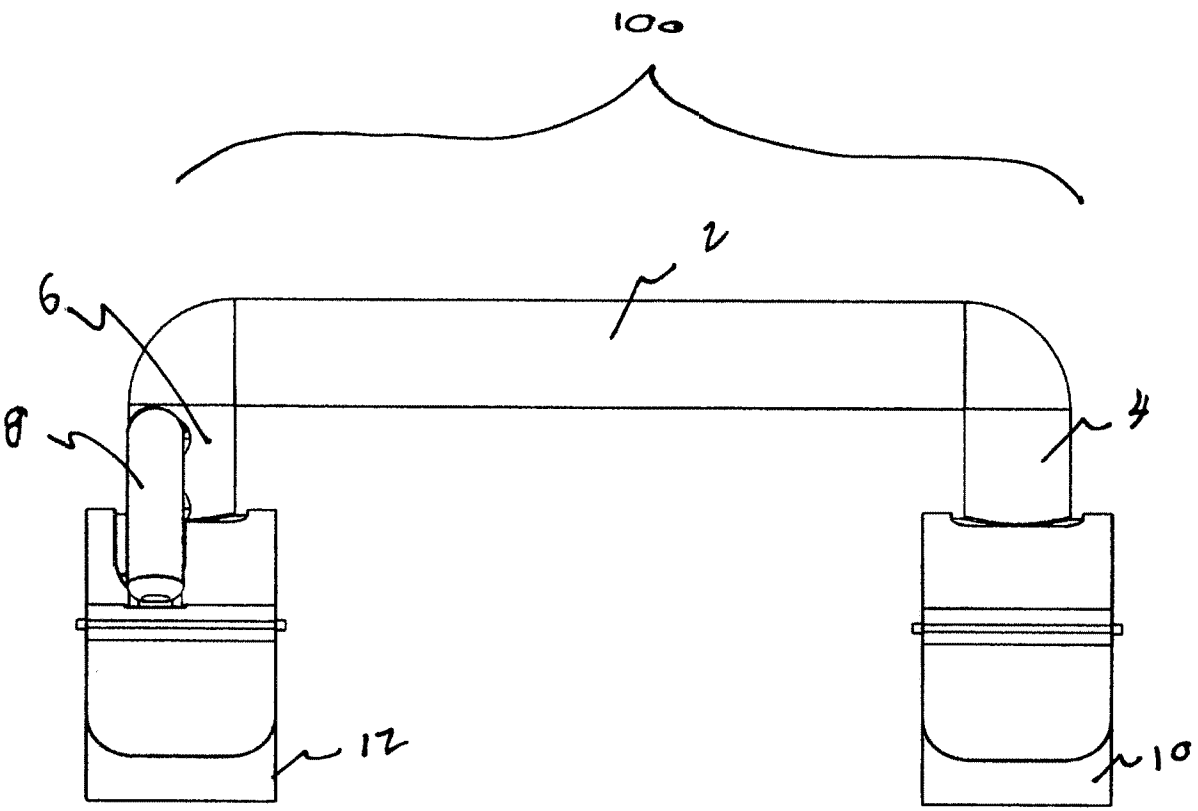
FIG. 3 is a side view of the invention.

FIG. 2 is a perspective view showing the invention 100 attached to a person's arm 22. This view clearly shows that a person wearing the invention 100 can be rescued either by the rescuer grabbing the long handle 2 or the short handle 8 or perhaps both at the same time, giving the rescuer greater opportunity to successfully pull a person out of the water when needed. Rubber overlay material located on top of both rigid handles 2, 8 provide additional frictional forces that help a rescuer maintain a grip on the handles 2, 8.

Figure 4:
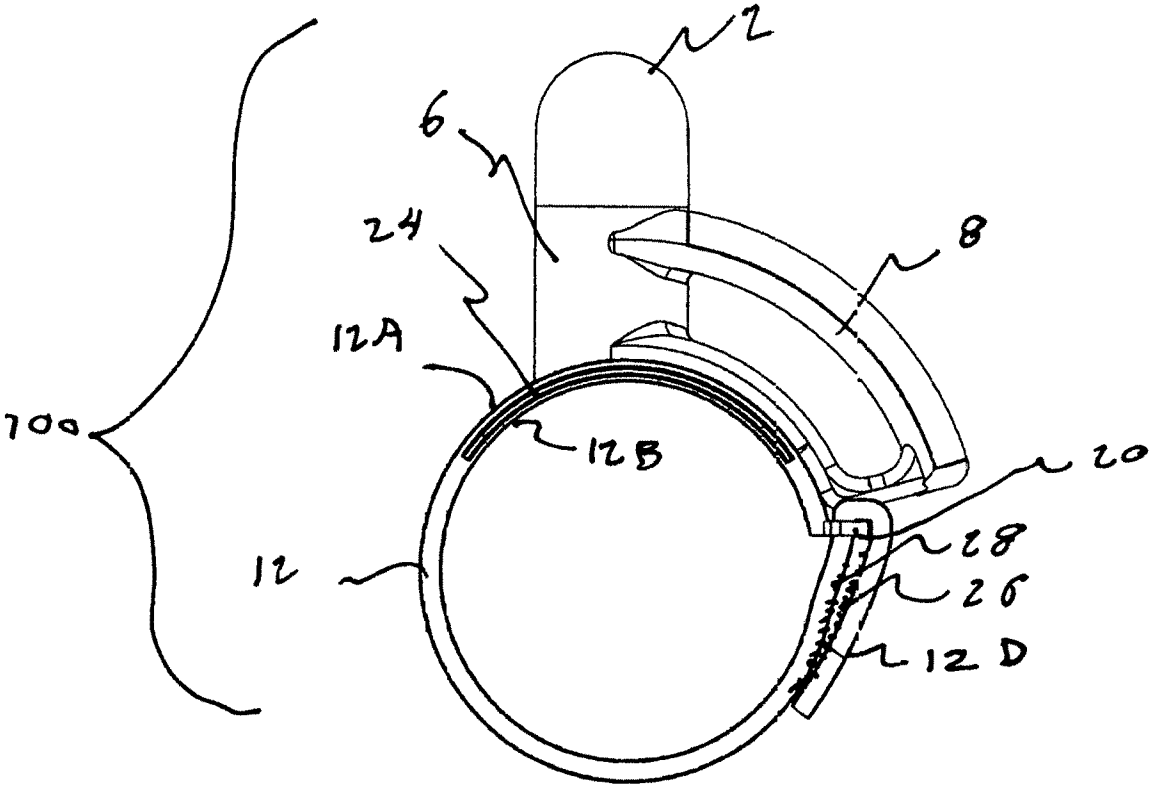
FIG. 4 is a front view of the invention.

FIG. 4 is a front view of the invention showing a head on view of the short handle 8 as it is attached to the downwardly disposed post 6 of long handle 2. The flexible strap 12 is clearly shown to have its end 12D wrapped over and around metal retainer 20 so that the hook fastener portion 26 of the strap releasably engages the loop fastener portion 28 is the case with Velcro type fastening devices. The user can therefore adjust the diameter of the straps 10, 12 so that the entire invention 100 fits snuggly onto the wearer's forearm. The strap 12 is divided into two layers 12A, 12B that allow rigid attachment plate 24 to be trapped between the layers 12A, 12B thereby creating a fixed connection between the rigid handles 2, 8 and the flexible straps 10, 12.

Figure 5:
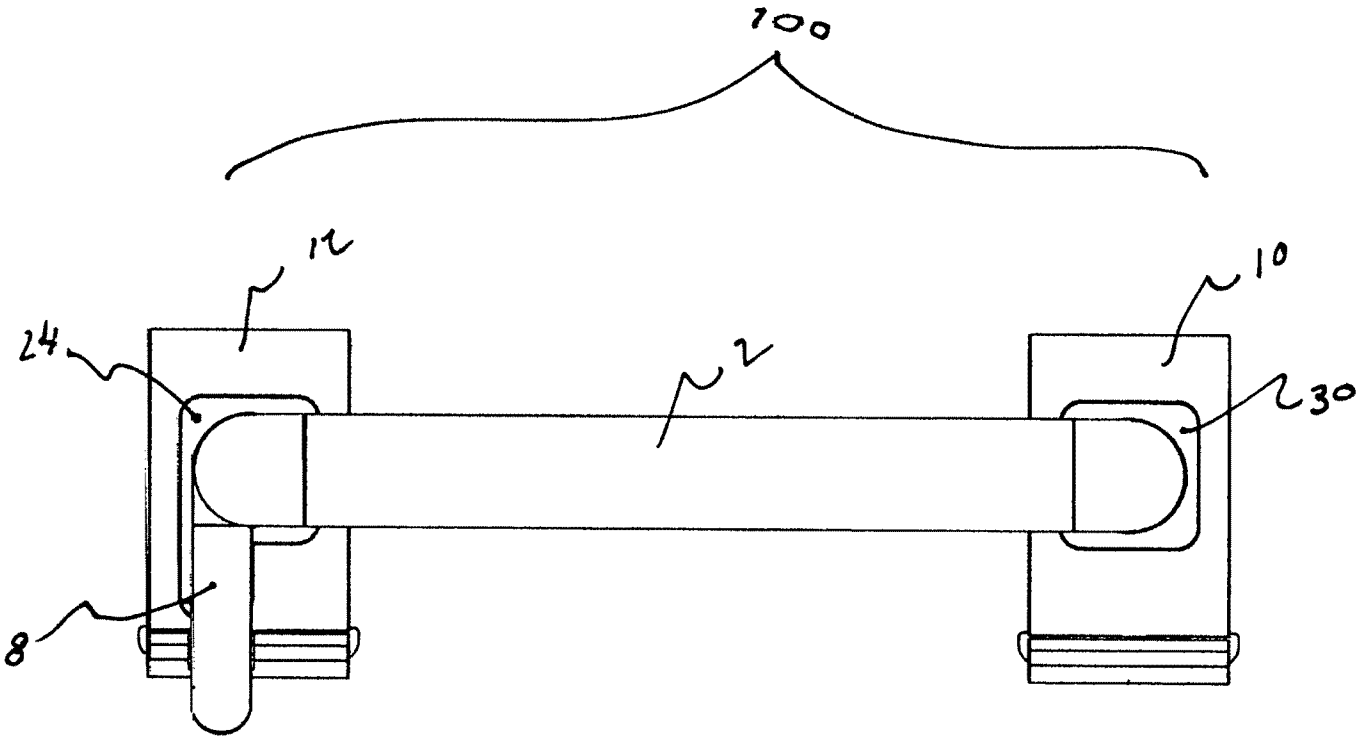
FIG. 5 is a top view of the invention.

FIG. 5 is a top view of the invention 100. This view clearly shows each rigid attachment plate 24, 30 trapped between the top and bottom layer of each strap 10, 12 as shown in FIG. 4.

Figure 6:
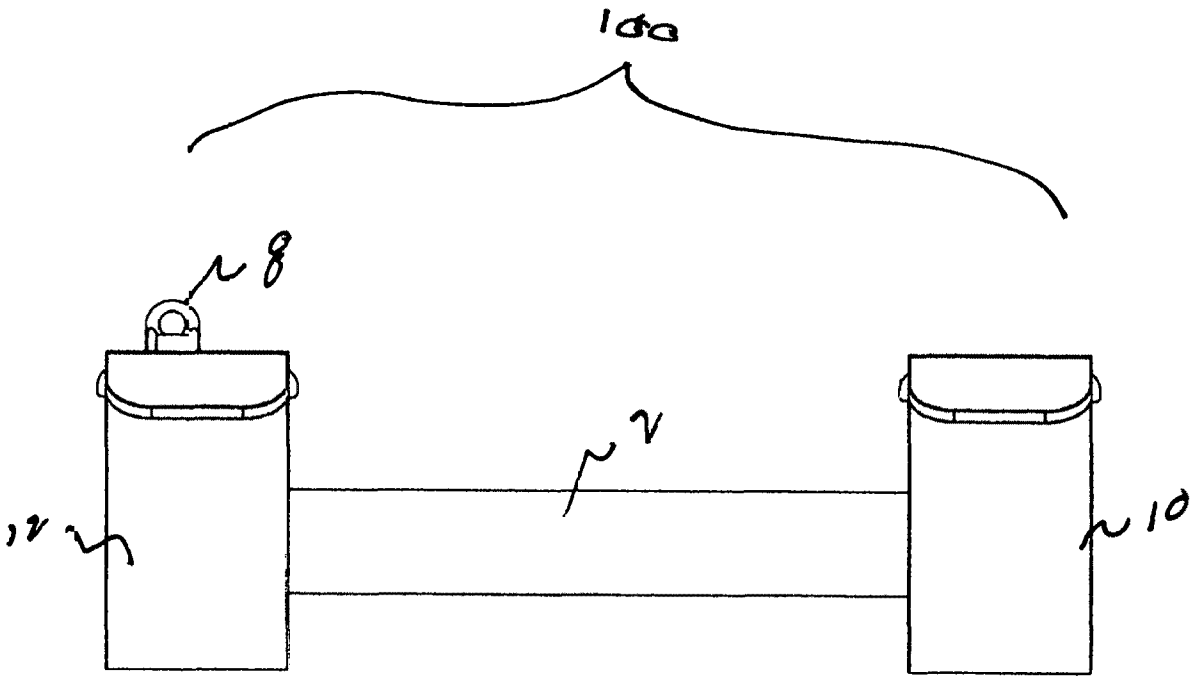
FIG. 6 is a bottom view of the invention.

FIG. 6 is a bottom view of the invention 100 showing how the short handle 8 protrudes slightly beyond the outer edge of the strap 12.

Figure 7:
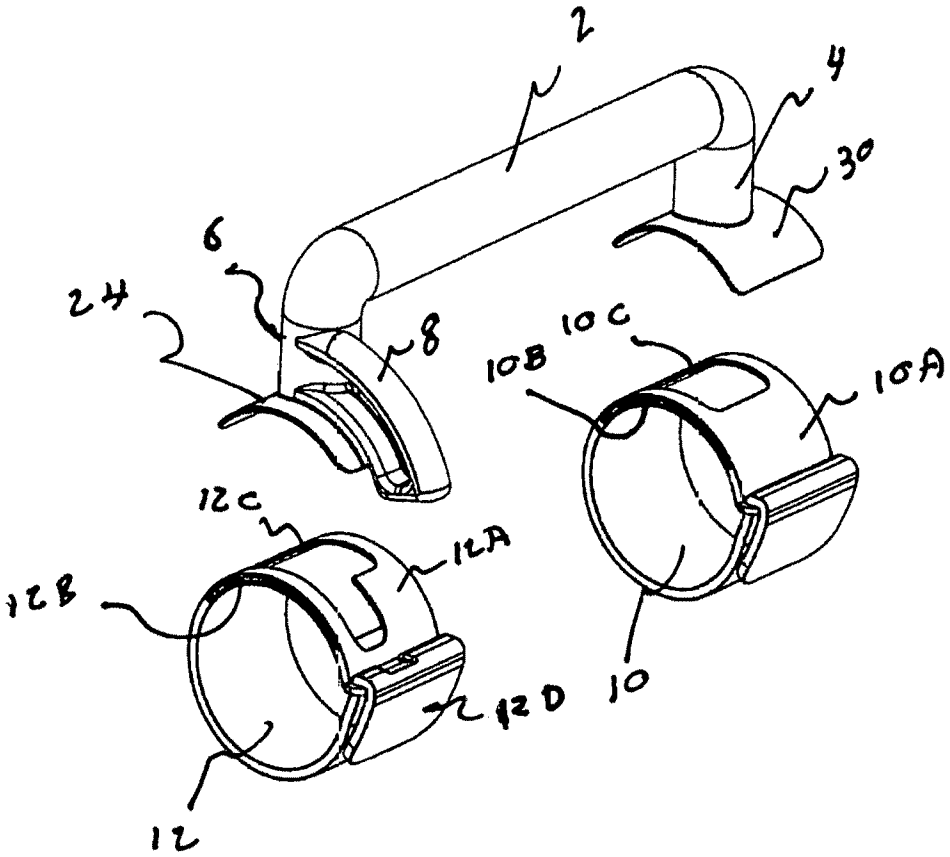
FIG. 7 is an exploded view of the invention.

FIG. 7 is an exploded view of the invention 100 clearly showing how the curved attachment pieces 24, 30 are fixed to the bottom of posts 6 and 4. The cutout portions 10C, 12C allow the posts 4, 6 to extend up and out of the straps 10, 12. The top layer 12A is then adhered by standard means, such as sewing or gluing, to the bottom layer 12B to trap the curved plates 24, 30 in place.

It should be noted that the present invention 100 can be used for other safety related purposes, such as wearing the device while hunting or hiking so that a guide can safely hold onto an inexperienced hiker that is wearing the device 100 by grasping either the long or the short handle so that they do not accidentally fall or slip.

The above described and illustrated invention provides a novel and effective method when used as an aid for rescuing a person who needs to be pulled up and away from a water environment such as a river, a bay, a lake or an ocean.

Additionally, the device 100 can be used in conjunction with physical therapy, elderly assistance and for snow skiing guides.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An arm rescue device comprising:

a long rigid grab handle;

a short rigid grab handle;

a first attachment strap;

a second attachment strap;

said long rigid grab handle terminating at the distal end in a downward disposed extension post terminating in a rigid attachment plate;

said long rigid grab handle terminating at the proximal end in a downward disposed extension post terminating in a rigid attachment plate and said short rigid grab handle which is perpendicular to said long rigid grab handle; and said first and second attachment straps each including a double layer allowing said rigid attachment plate to reside between the said double layers causing said attachment plates to be fixed to said attachment straps.

2. An arm rescue device as claimed in claim 1 wherein said long rigid grab handle and said short rigid grab handle each include resilient rubber-like coverings that provide a more secure grip for a rescuer when in the process rescuing a person wearing said arm rescue device.

3. An arm rescue device as claimed in claim 1 wherein said attachment straps are made to include hook and loop fastener material and where a rectilinear metal strap holder allows hook fastener material located at the end of said strap to be pulled through said rectilinear strap holder and be fastened onto the loop type faster material located on the mid-section of said strap.

* * * * *